US011391022B1

(12) United States Patent
Lo et al.

(10) Patent No.: US 11,391,022 B1
(45) Date of Patent: Jul. 19, 2022

(54) FAUCET DIVERTER

(71) Applicant: YUAN MEI CORP., Changhua County (TW)

(72) Inventors: Shun-Nan Lo, Changhua County (TW); Wei-Kai Huang, Changhua County (TW)

(73) Assignee: YUAN MEI CORP., Changhua County (TW)

( * ) Notice: Subject to any disclaimer, the term of this patent is extended or adjusted under 35 U.S.C. 154(b) by 0 days.

(21) Appl. No.: 17/147,465

(22) Filed: Jan. 13, 2021

(51) Int. Cl.
*E03C 1/02* (2006.01)
*E03C 1/048* (2006.01)
*E03C 1/08* (2006.01)

(52) U.S. Cl.
CPC ..... *E03C 1/023* (2013.01); *E03C 1/048* (2013.01); *E03C 1/08* (2013.01); *E03C 2001/082* (2013.01); *E03C 2201/30* (2013.01)

(58) Field of Classification Search
CPC ..... E03C 1/023; E03C 1/048; E03C 1/08
USPC ..... 4/601, 567; 239/581.1; 137/625.46
See application file for complete search history.

(56) References Cited

U.S. PATENT DOCUMENTS 8,082,610 B2 * 12/2011 Henry ..... E03C 1/023 4/601
9,663,927 B2 * 5/2017 Lo ..... E03C 1/023

* cited by examiner

*Primary Examiner* — Tuan N Nguyen
(74) *Attorney, Agent, or Firm* — Raymond Chan

(57) ABSTRACT

A faucet diverter is revealed. The faucet diverter is coupled to a faucet and composed of a coupling part, a first assembly part, a second assembly part, a spray part and a control part. A water flow from the coupling part is redirected to the first assembly part, the second assembly part, or the spray part by operating the control part.

16 Claims, 19 Drawing Sheets

FAUCET DIVERTER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a faucet diverter, especially to a faucet diverter which is connected to an outlet of a faucet and provided with a plurality of channels and a control part for switching the channel water flow passes.

Description of Related Arts

Refer to U.S. Pat. No. 9,663,927, a faucet diverter is revealed. The faucet diverter includes a main body, an inlet part, a first outlet part, a second outlet part, and a control part. The inlet part is used for being coupled to an outlet of the faucet. The first outlet part comprises a pipe member, a positioning member, a first rotary member, a second rotary member and an outlet head. The outlet head of the first outlet part can be turned around 180 degrees by the assembly of the first rotary member with the second rotary member. The outlet head is connected to a hose and then the water is discharged through the outlet head. The inlet part is arranged at the top of the main body while the first outlet part and the control part are disposed on two sides of the main body respectively and corresponding to each other. That means the first outlet part and the control part are disposed on two sides of the main body respectively and correspondingly at the front view of the main body after the inlet part being coupled to the outlet of the faucet. While operating the control part to switch the water flow, the control part is fully visible only from a side view. Thus it is not convenient for users to operate the control part.

SUMMARY OF THE PRESENT INVENTION

Therefore it is a primary object of the present invention to provide a faucet diverter which features on rotary members able to rotate to different directions and the position where the control part for switching the channel for water discharge is arranged. Thereby the above shortcomings are addressed and the faucet diverter is more convenient to use.

In order to achieve the above object, a faucet diverter according to the present invention is coupled to a faucet and having a plurality of channels for connection to a plurality of hoses. The faucet diverter includes a main body, a coupling part, a first assembly part, a second assembly part, a spray part and a control part. A first end, a second end, a third end, and a fourth end are extended from the main body while the first assembly part and the second assembly part are arranged at the second end and the third end respectively. The main body includes an inlet channel, a first channel, a second channel, a third channel, a fourth channel, and a diversion part. The inlet channel, the first channel, and the second channel are communicating with the coupling part, the first assembly part, and the second assembly part respectively while the third channel and the fourth channel are communicating with the spray part.

The coupling part is coupled to a faucet.

The first assembly part consists of a first rotary member, a first rotating part, and a second rotary member which is fixed and connected to a first connection part.

The second assembly part consists of a second rotating part, a third rotary member, and a fourth rotary member which is fixed and connected to a second connection part.

The spray part is fixed and connected to the fourth end of the main body firmly and is composed of a spray disc and a baffle plate mounted into the spray disc. The baffle plate is provided with a first guiding hole and at least one second guiding slot. The spray disc includes a first outlet hole and second outlet holes which are corresponding to the first guiding hole and the second guiding slots of the baffle plate respectively. The first guiding hole and the second guiding slot of the baffle plate are correspondingly to the third channel and the fourth channel respectively.

The control part includes a valve and an operation member.

The first rotary member is connected to the first channel of the main body and able to rotate 360 degrees in relation to the main body. The first rotary member is pivotally connected to the second rotary member so that the second rotary member can turn 180 degrees in relation to the first rotary member. The first connection part can be connected to a hose to let water flow out.

The third rotary member is pivotally connected to the second channel of the main body and able to rotate 360 degrees in relation to the main body. The third rotary member is pivotally connected to the fourth rotary member so that the fourth rotary member can turn 180 degrees in relation to the third rotary member. The second connection part can be connected to a hose to let water flow out.

Thereby users can rotate the control part to switch the water flow from the inlet channel to the spray part, the first assembly part, or the second assembly part through the valve to be discharged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
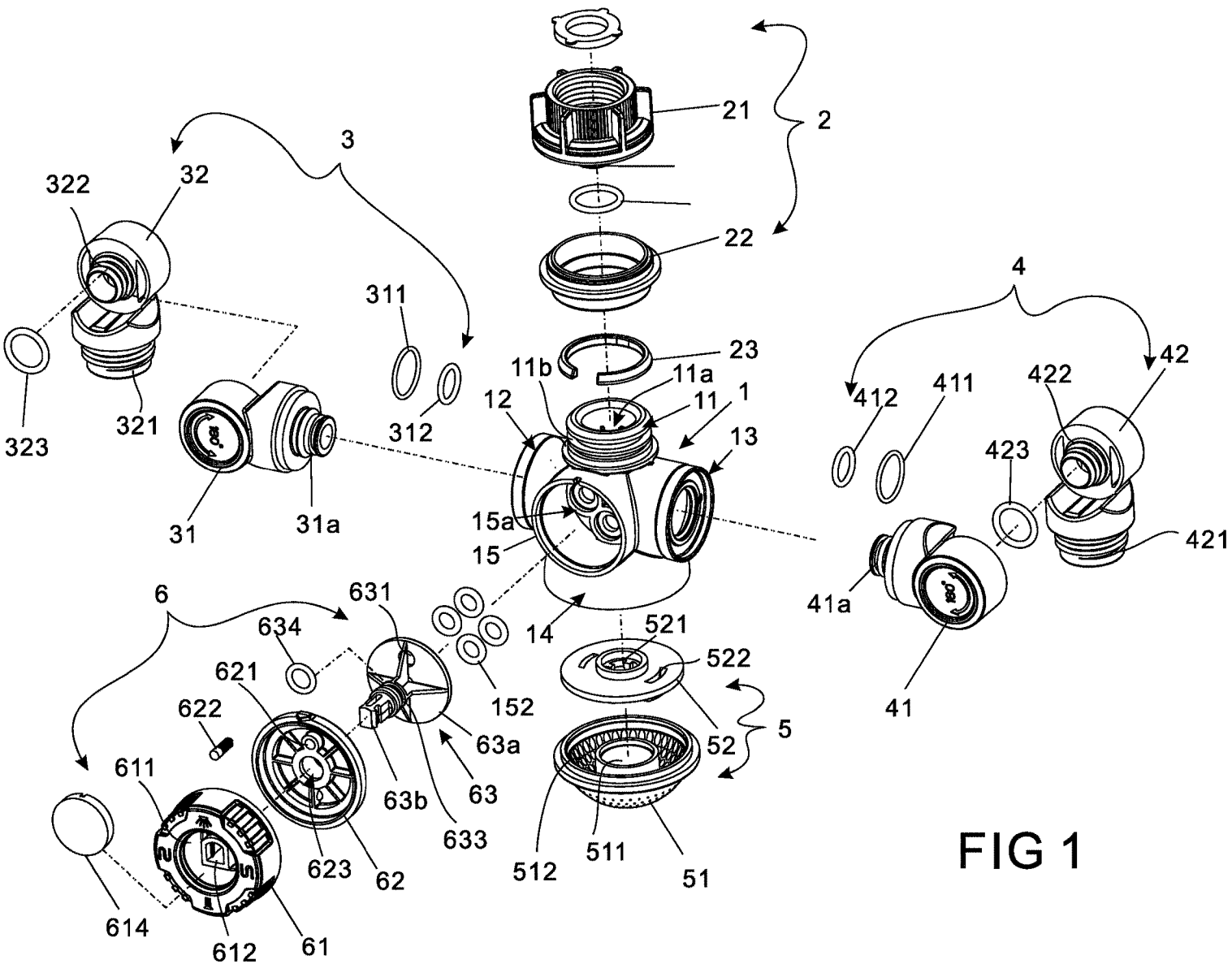
FIG. 1 is an explosive view of an embodiment according to the present invention.

In order to learn technical content and functions of the present invention more completely and clearly, please refer to the following embodiments with detailed descriptions and with reference to the related figures and numbers therein.

Refer to FIGS. 1-5 and FIG. 15, a faucet diverter according to the present invention includes a main body 1, a coupling part 2, a first assembly part 3, a second assembly part 4, a spray part 5 and a control part 6.

A first end 11, a second end 12, a third end 13, a fourth end 14 and a fifth end 15 are extended from the main body 1. The first end 11, the second end 12, and the third end 13 include an inlet channel 11*a*, a first channel 12*a*, and a second channel 13*a* respectively while the fourth end 14 includes a third channel 14*a* and a fourth channel 14*b*. The inlet channel 11*a*, the first channel 12*a*, the second channel 13*a*, the third channel 14*a* and the fourth channel 14*b* are separated from each other, which is defined as each of the first end 11, the second end 12, the third end 13, and the fourth end 14 has an independent channel and the respective independent channels are not communicating with one another. As to the fifth end 15, it is provided with a diversion part 15*a* while a first outlet port 151*a*, a second outlet port 151*b*, a third outlet port 151*c*, and a fourth outlet port 151*d* are extended from the diversion part 15*a* and communicating with the respective independent channels of the first end 11, the second end 12, the third end 13, and the fourth end 14. A water stop gasket 152 is fitted around the first outlet port 151*a*, the second outlet port 151*b*, the third outlet port 151*c*, and the fourth outlet port 151*d*. A second circular groove 11*b* is formed by extension of the outer circumference of the first end 11. The first outlet port 151*a* is aligned and communicating with the fourth channel 14*b* while the second outlet port 151*b*, the third outlet port 151*c*, and the fourth outlet port 151*d* are aligned and communicating with the first channel 12*a*, the second channel 13*a*, and the third channel 14*a* respectively.

The inlet channel 11*a*, the first channel 12*a*, and the second channel 13*a* are connected to the coupling part 2, the first assembly part 3, and the second assembly part 4 respectively while the third channel 14*a* and the fourth channel 14*b* are connected to the spray part 5.

The coupling part 2 which is coupled to a faucet A is composed of a coupling head 21, a bushing part 22, and a stop collar 23. A first circular grove 22*a* is formed on an inner circumference of bushing part 22 while the coupling head 21 is tightly connected to an upper edge of the bushing part 22 to form one part. The stop collar 23 is an elastic ring with an opening so that the stop collar 23 can be expanded or contracted. The stop collar 23 is mounted in the second circular groove 11*b* at the first end 11 of the main body 1 and the bushing part 22 is mounted to the outer circumference of the first end 11 of the main body 1. By the elasticity of the stop collar 23, the bushing part 22 is kept at the first end 11 of the main body 1, without falling off, and able to rotate around the axis for pivotal rotation and fastening while the coupling head 21 is connected to the faucet A. In order to assemble the coupling head 21 with the faucet A, the coupling part 2 can be released in a non-destructive way, preferably released manually without using any tools. The coupling part 2 can also include other assembly structure such as snap fasteners or screws for being mounted and fixed to the faucet A.

The first assembly part 3 consists of a first rotary member 31 and a second rotary member 32. A first rotating part 31*a* is extended from the first rotary member 31. After a first water stop collar 311 and a second water stop collar 312 being disposed around the first rotating part 31*a* and the first rotating part 31*a* being pivotally connected to the second end 12, the first rotating part 31*a* can rotate 360 degrees in relation to the second end 12. One end of the second rotary member 32 is extended to form a first axle tube 322 while a first connection part 321 is disposed on the other end thereof. The first connection part 321 can be connected to a water hose. After a third water stop collar 323 being arranged around the first axle tube 322, the first axle tube 322 is pivotally connected to the first rotary member 31. Thereby the second rotary member 32 can rotate 180 degrees in relation to the first rotary member 31. The first rotating part 31*a*, the first rotary member 31, the second rotary member 32, and the first connection part 321 all include passages communicating with one another and combined to form a second passage 33*a* which is aligned and communicating with the first channel 12*a* of the main body 1.

The second assembly part 4 is composed of a third rotary member 41 and a fourth rotary member 42. A second rotating part 41*a* is extended from the third rotary member 41 and able to rotate 360 degrees in relation to the third end 13 after being arranged with a fourth water stop collar 411 and a fifth water stop collar 412 and pivotally connected to the third end 13. One end of the fourth rotary member 42 is extended to form a second axle tube 422 while a second connection part 421 is disposed on the other end thereof. The second connection part 421 can be connected to a water hose. The second axle tube 422 is pivotally connected to the third rotary member 41 after being arranged with a sixth water stop collar 423. Thereby the fourth rotary member 42 can rotate 180 degrees in relation to the third rotary member 41. The first second pivotally rotating part 41*a*, the third rotary member 41, the fourth rotary member 42, and the second connection part 421 all include passages communicating with one another and combined to form a third passage 43*a* which is aligned and communicating with the second channel 13*a* of the main body 1.

The spray part 5 includes a spray disc 51 and a baffle plate 52. The baffle plate 52 is provided with a first guiding hole 521 disposed on the center of the baffle plate 52 and two guiding slot 522 on two sides of the first guiding hole 521. In other embodiments, there is at least one guiding slot 522. The spray disc 51 includes a first outlet hole 511 and a plurality of second outlet holes 512 which are corresponding to the first guiding hole 521 and the second guiding slots 522 of the baffle plate 52 respectively. The baffle plate 52 is mounted into the spray disc 51 to form the spray part 5 which is fixed and connected to the fourth end 14 of the main body 1 firmly. The first guiding hole 521 and the second guiding slot 522 of the baffle plate 52 are aligned with the third channel 14*a* and the fourth channel 14*b* respectively.

The control part 6 includes an operation member 61, a cover body 62, and a valve 63. The operation member 61 is provided with a mounting part 611 and a connection part 612 while a seal member 614 is mounted to the mounting part 611. As to the cover body 62, it consists of a side hole 621, a pin 622, and an axial hole 623. After being fit with a spring, one end of the pin 622 is mounted into the side hole 621. The valve 63 is a round disc 63*a* provided with a valve hole 631 while a rod 63*b* is extended from the center of the disc 63*a* and is provided with a circular groove 633 in which an oil seal ring 634 is mounted. One side of the operation member 61 facing the cover body 62 is provided with a plurality of recesses 613 arranged circularly. The other end of the pin 622 can be selectively mounted into one of the recesses 613 for temporary positioning after the operation member 61 being rotated.

The disc 63*a* of the valve 63 is mounted into the fifth end 15 and corresponding to a surface on one end of the diversion part 15*a* while the valve hole 631 of the disc 63*a* can be selectively aligned with the first outlet port 151*a*, the second outlet port 151*b*, the third outlet port 151*c*, or the fourth outlet port 151*d* of the diversion part 15*a*. The rod 63*b* is inserted through the axial hole 623 of the cover body 62 to be fixed and connected to the connection part 612 of the operation member 61. The periphery of the cover body 62 can be tightly connected to the outer circumference of the fifth end 15 by ultrasonic waves.

Figure 5:
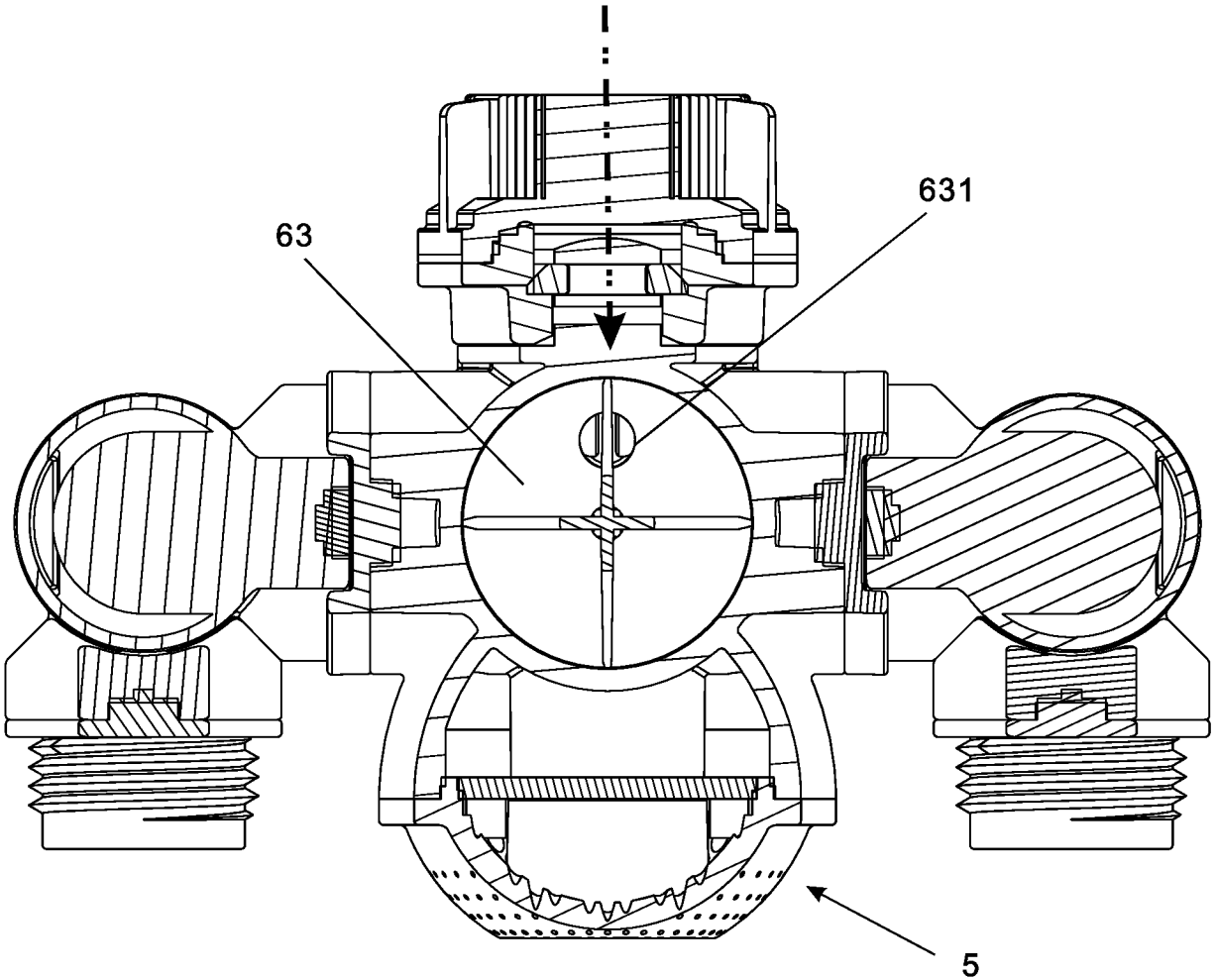
FIG. 5 is a sectional view of an embodiment showing a valve hole aligned with a first outlet port according to the present invention.
Figure 6:
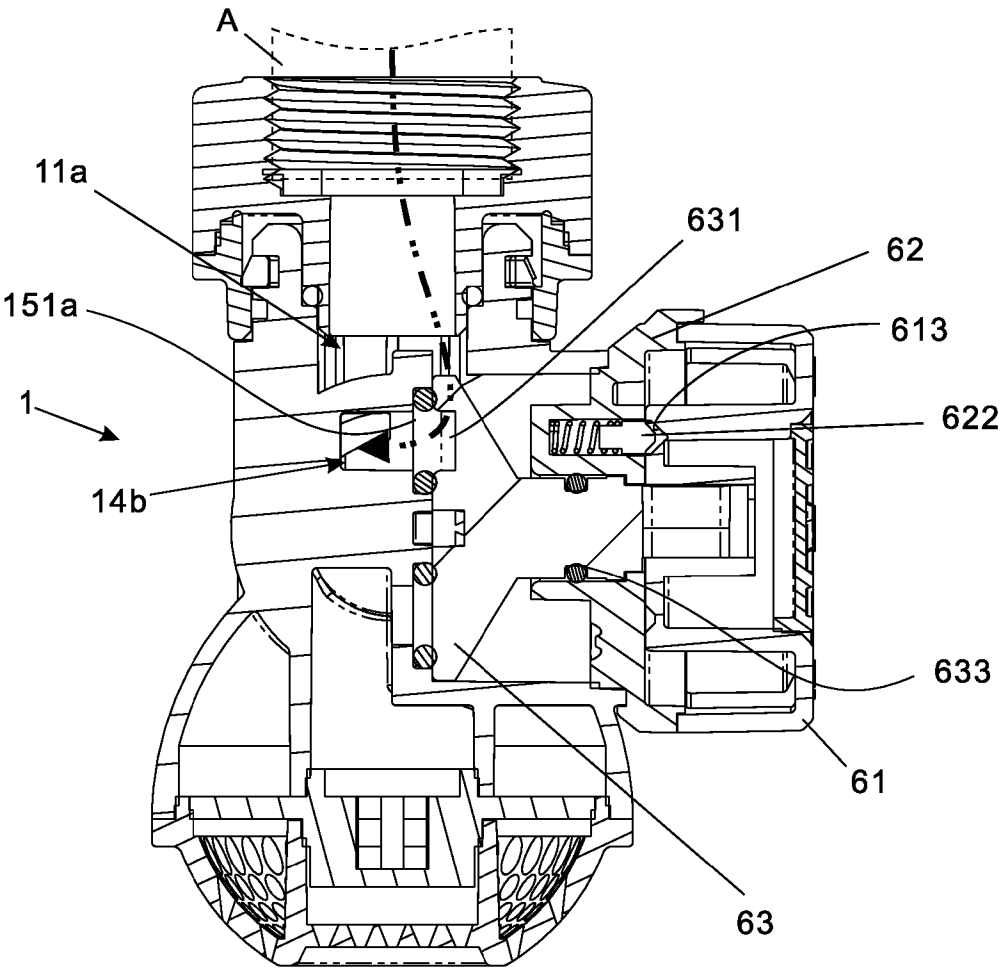
FIG. 6 is another sectional view of the embodiment in FIG. 5 according to the present invention.
Figure 7:
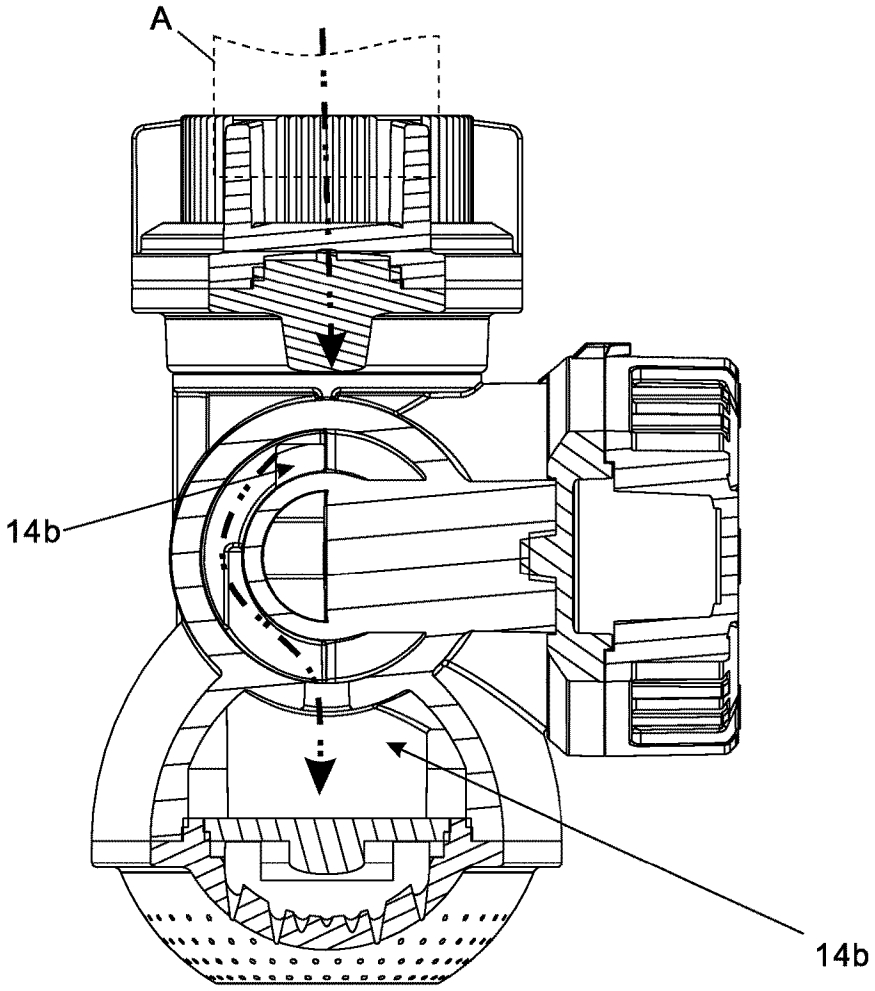
FIG. 7 is a further sectional view of the embodiment in FIG. 5 according to the present invention.
Figure 8:
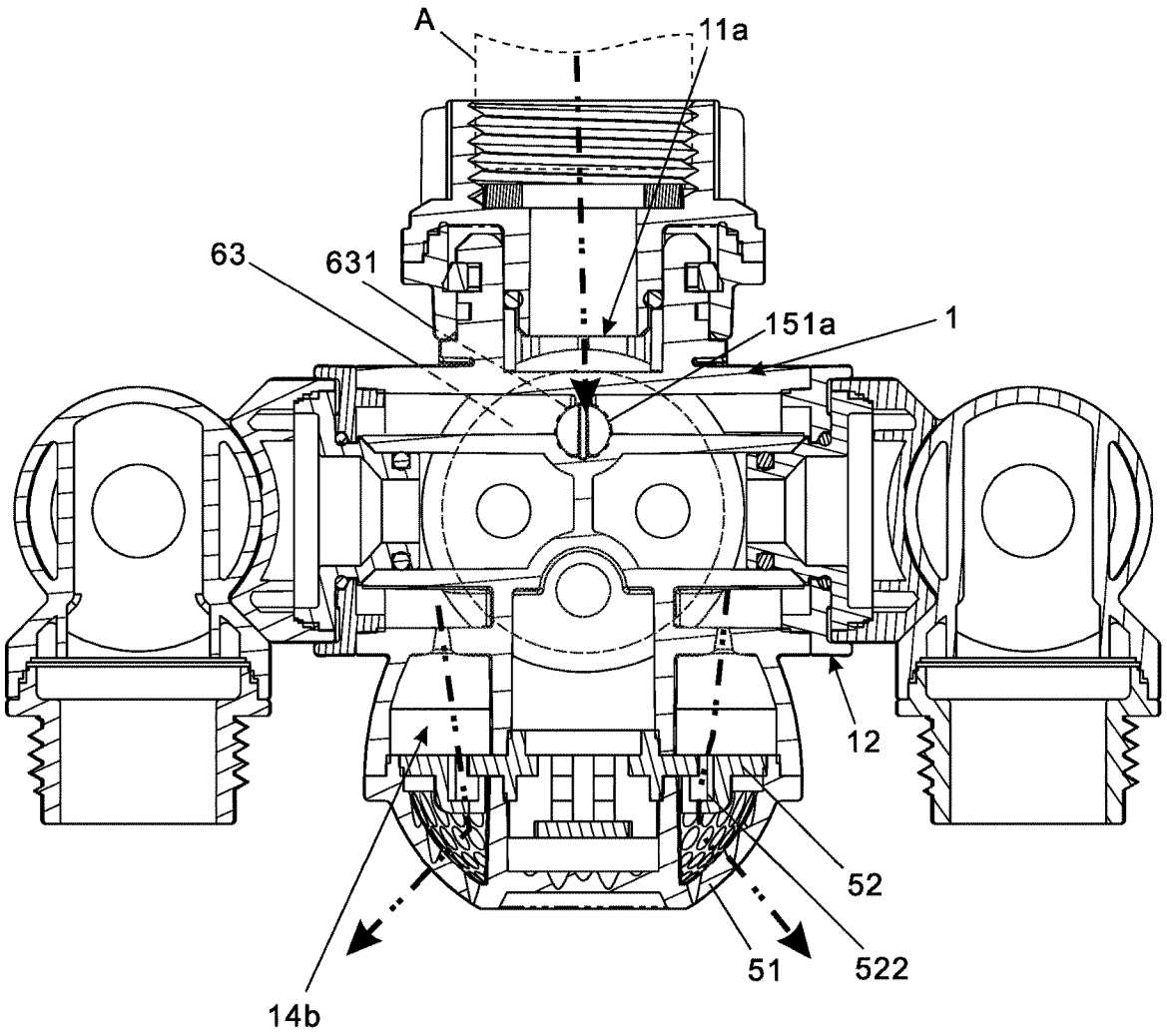
FIG. 8 is a sectional view of an embodiment showing a water flow passed through a valve hole and a first outlet port aligned with each other and then flowing out through second outlet holes of a spray part according to the present invention.
Figure 9:
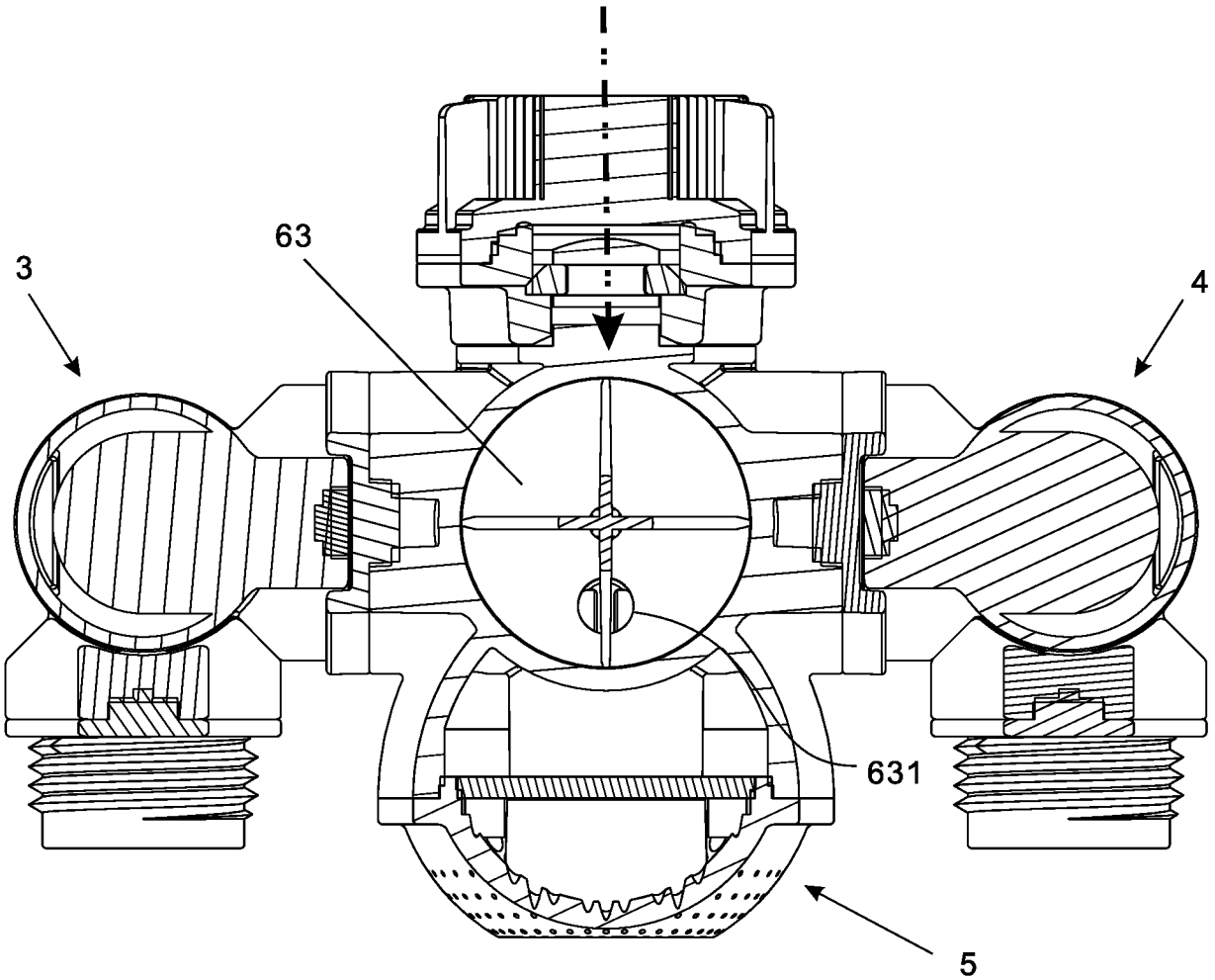
FIG. 9 is a sectional view of an embodiment showing a valve hole aligned with a fourth outlet port according to the present invention.
Figure 10:
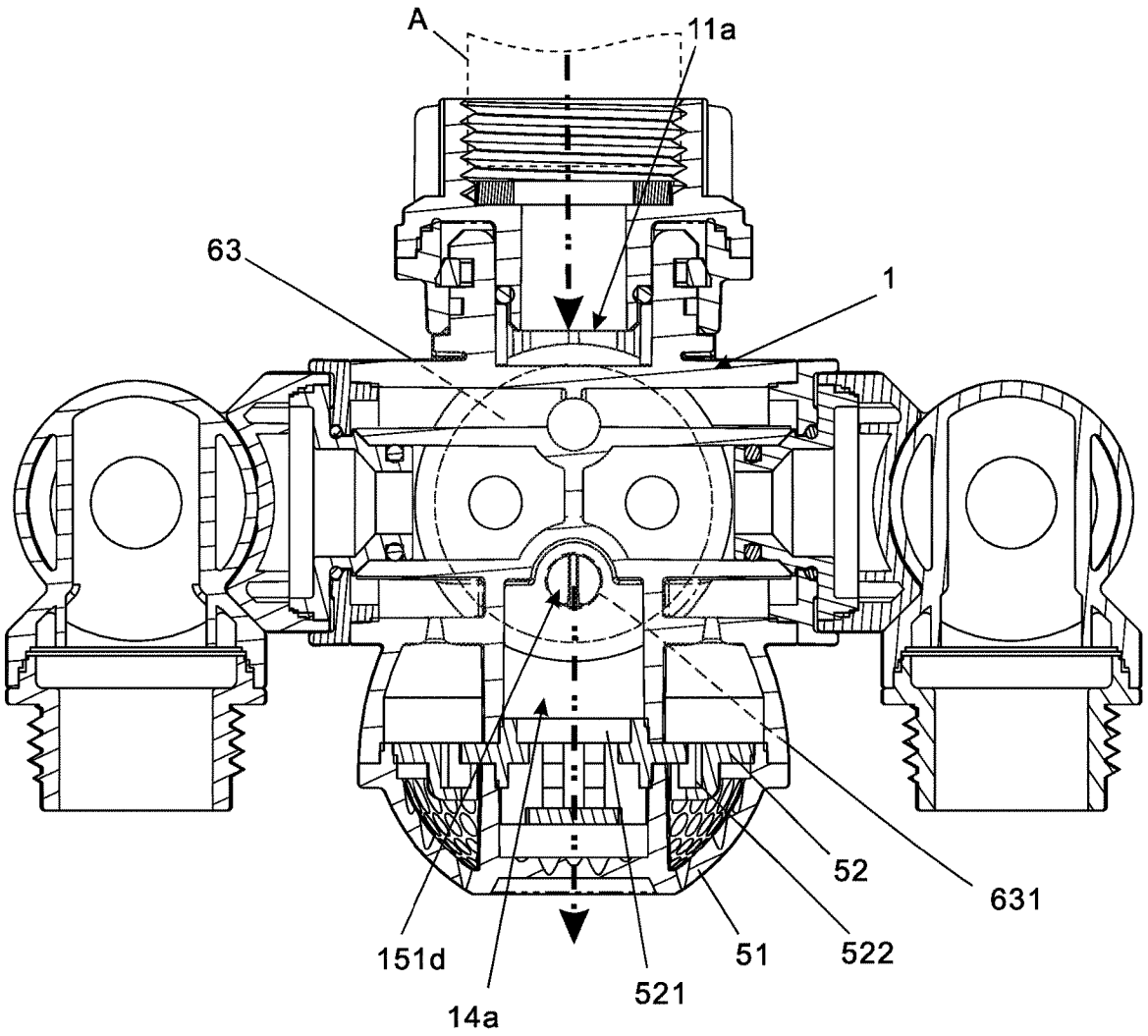
FIG. 10 is another sectional view of the embodiment in FIG. 9 according to the present invention.
Figure 11:
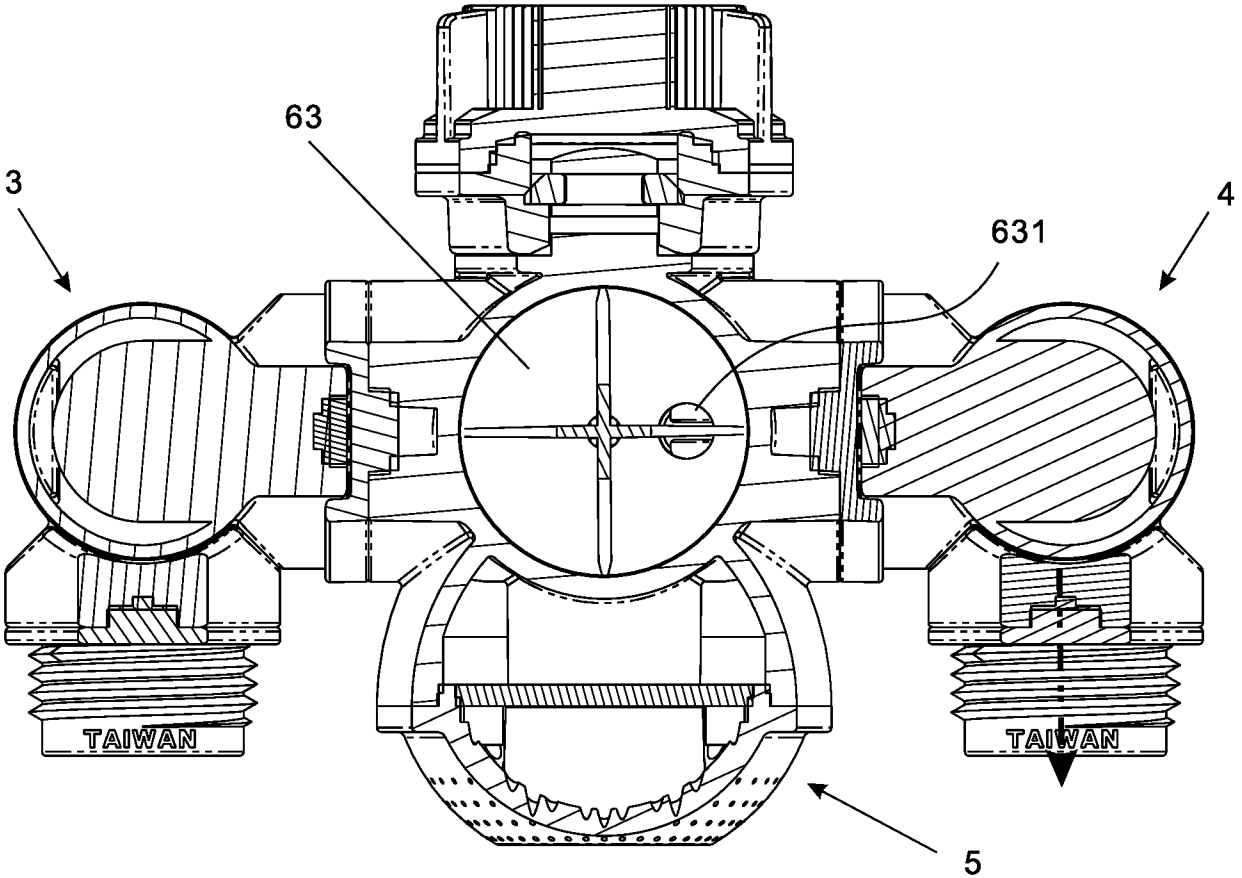
FIG. 11 is a sectional view of an embodiment showing a valve hole aligned with a third outlet port according to the present invention.
Figure 12:
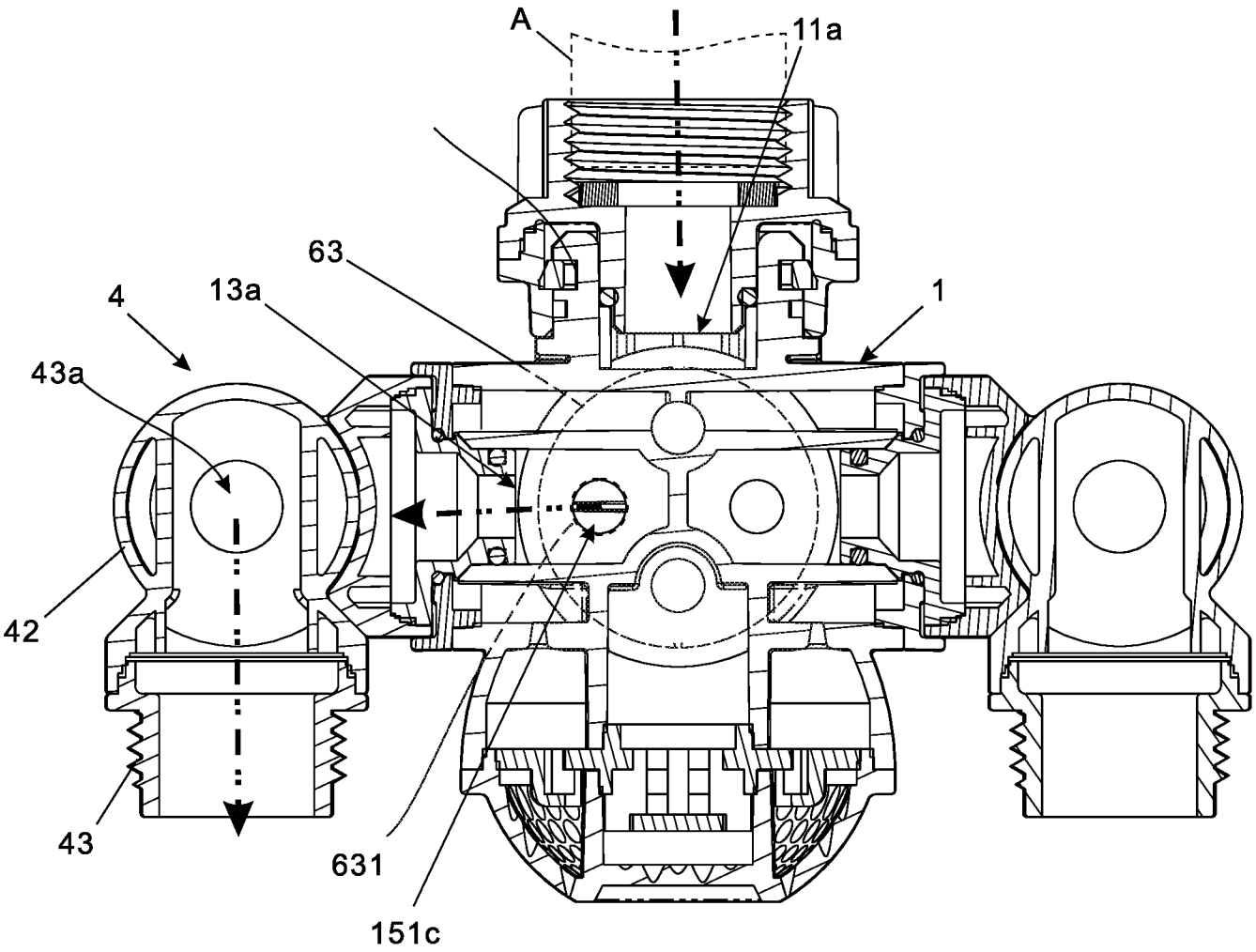
FIG. 12 is another sectional view of the embodiment in FIG. 11 according to the present invention.
Figure 13:
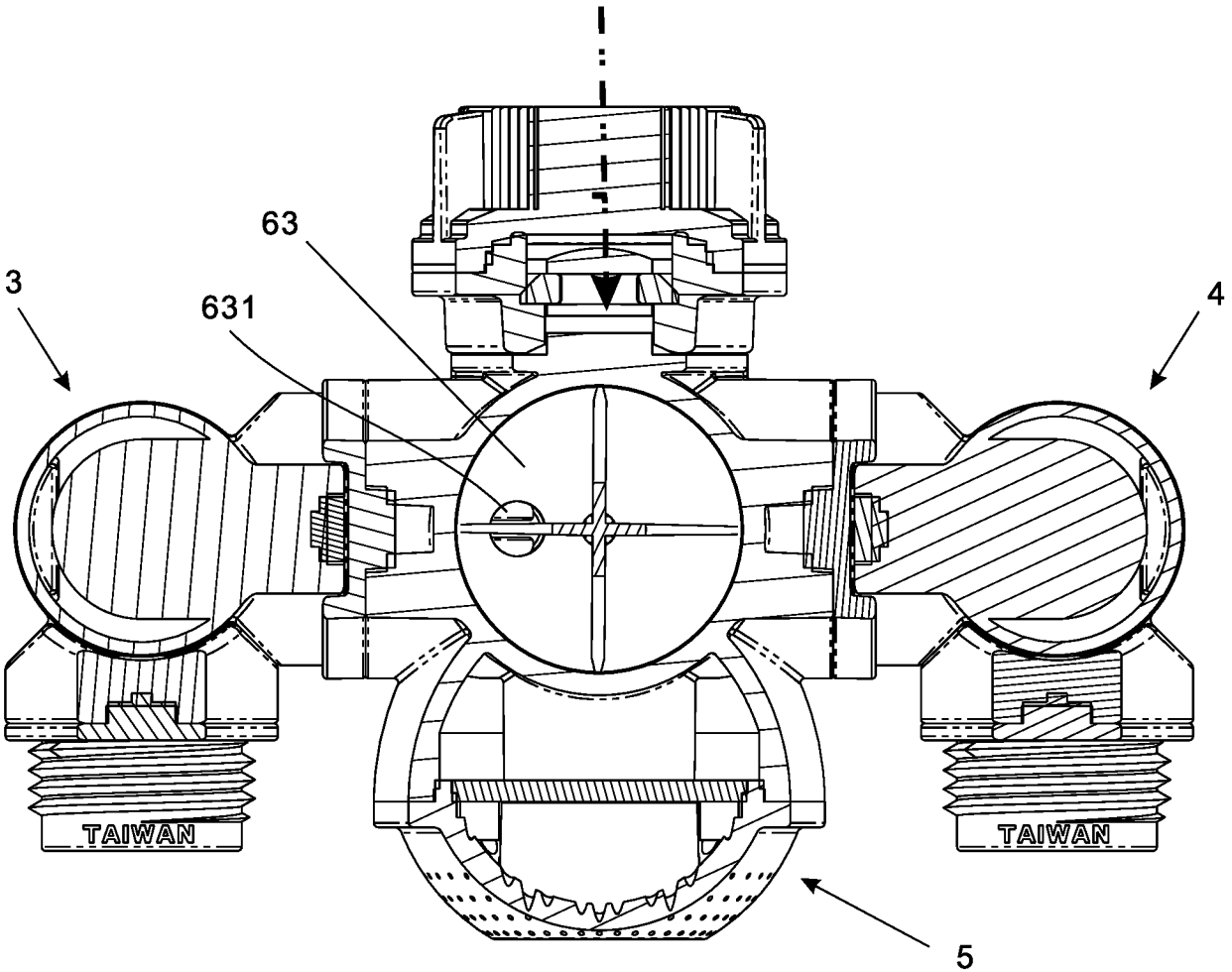
FIG. 13 is a sectional view of an embodiment showing a valve hole aligned with a third outlet port according to the present invention.
Figure 14:
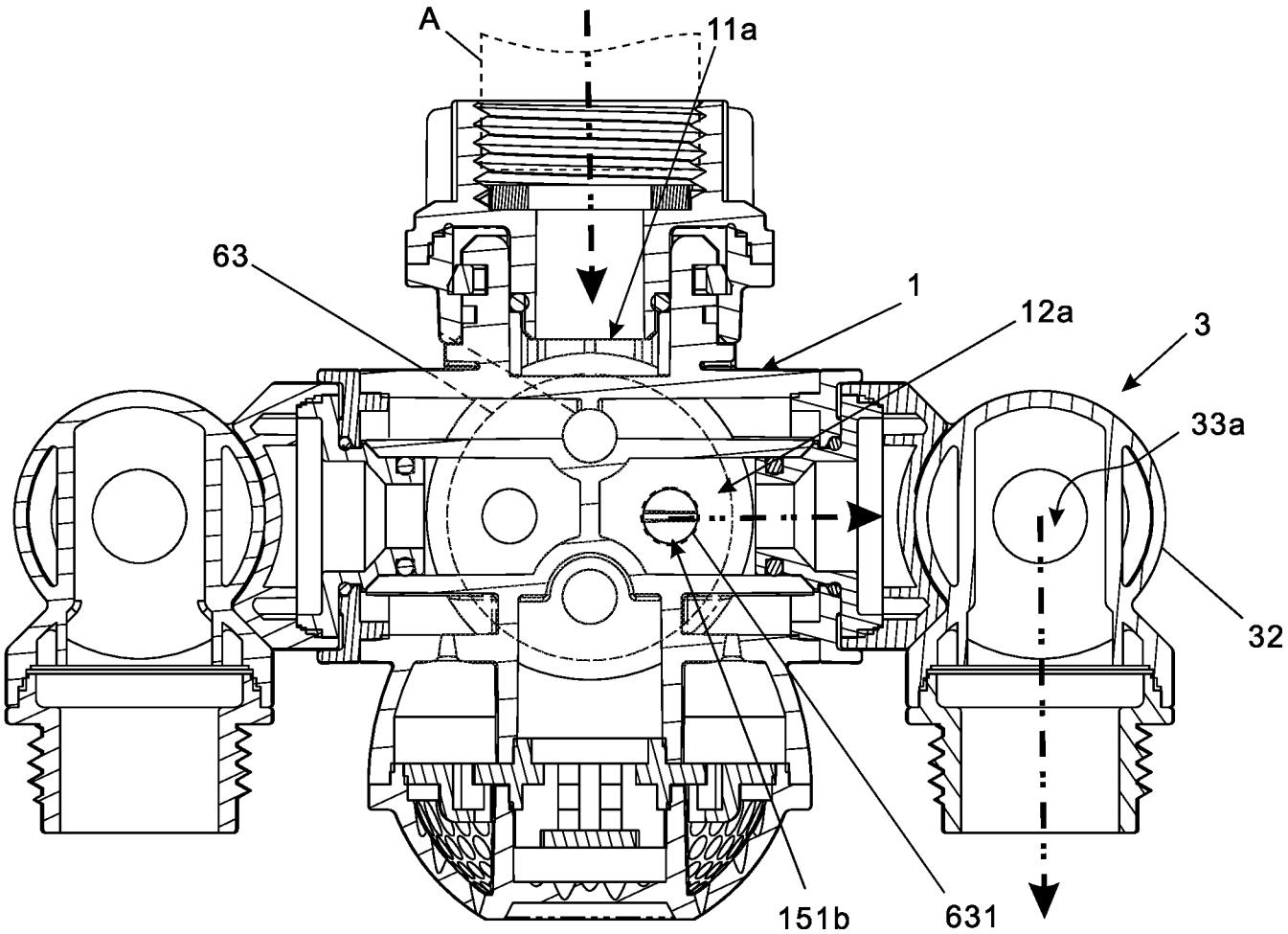
FIG. 14 is another sectional view of the embodiment in FIG. 13 according to the present invention.
Figure 15:
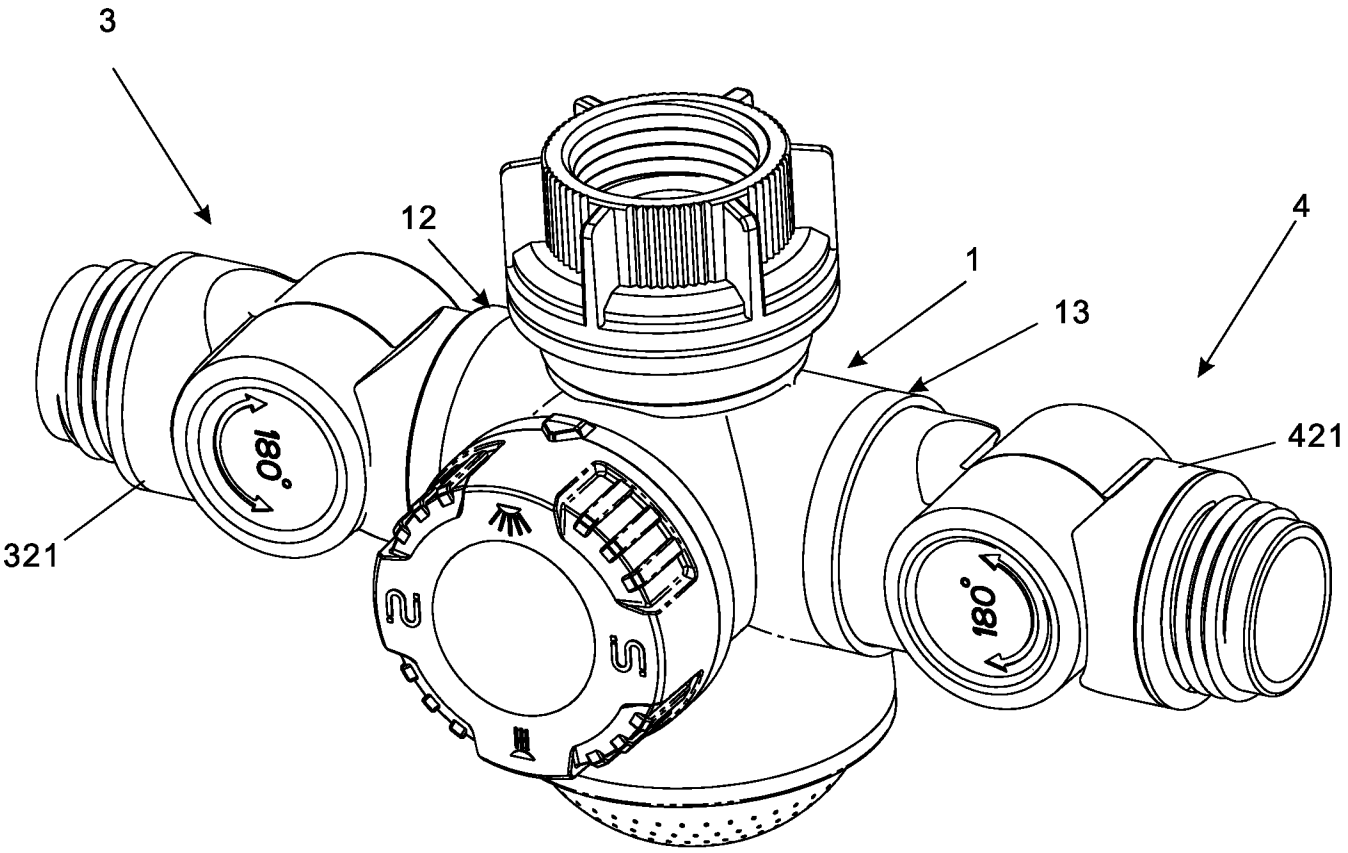
FIG. 15 is a perspective view of an embodiment showing a first assembly part and a second assembly part before being rotated according to the present invention.
Figure 16:
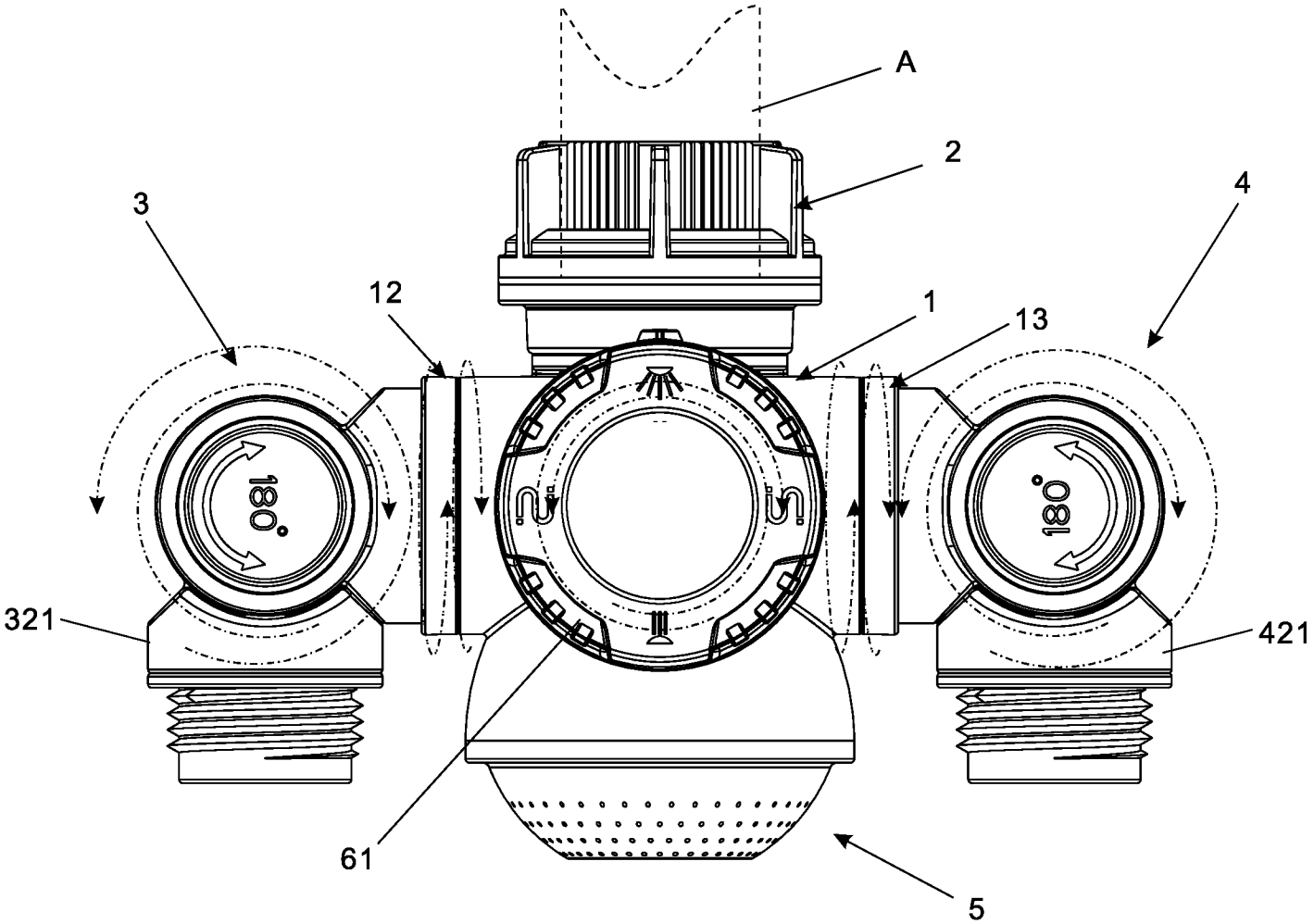
FIG. 16 is a perspective view of an embodiment showing a first assembly part and a second assembly part being rotated according to the present invention.
Figure 17:
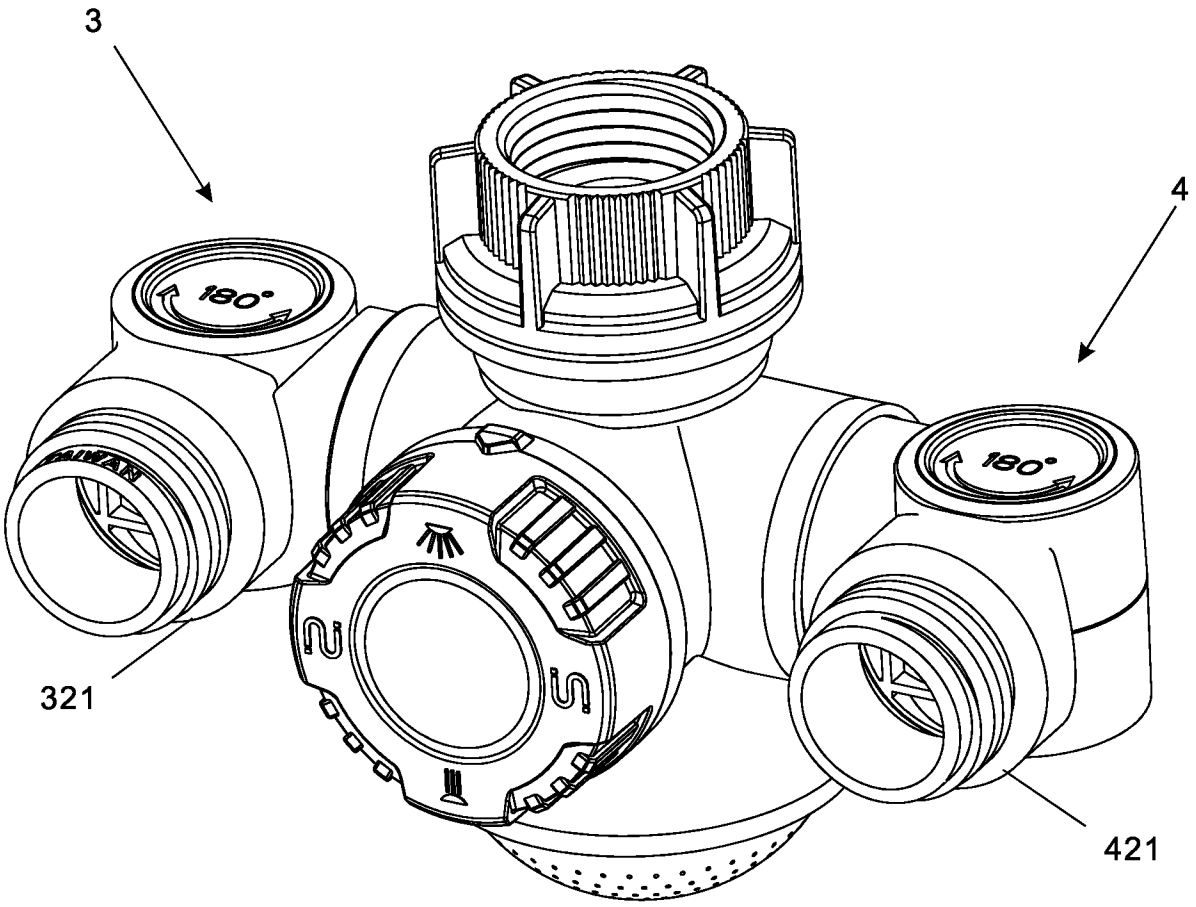
FIG. 17 is another perspective view of an embodiment showing a first assembly part and a second assembly part being rotated to another direction according to the present invention.
Figure 18:
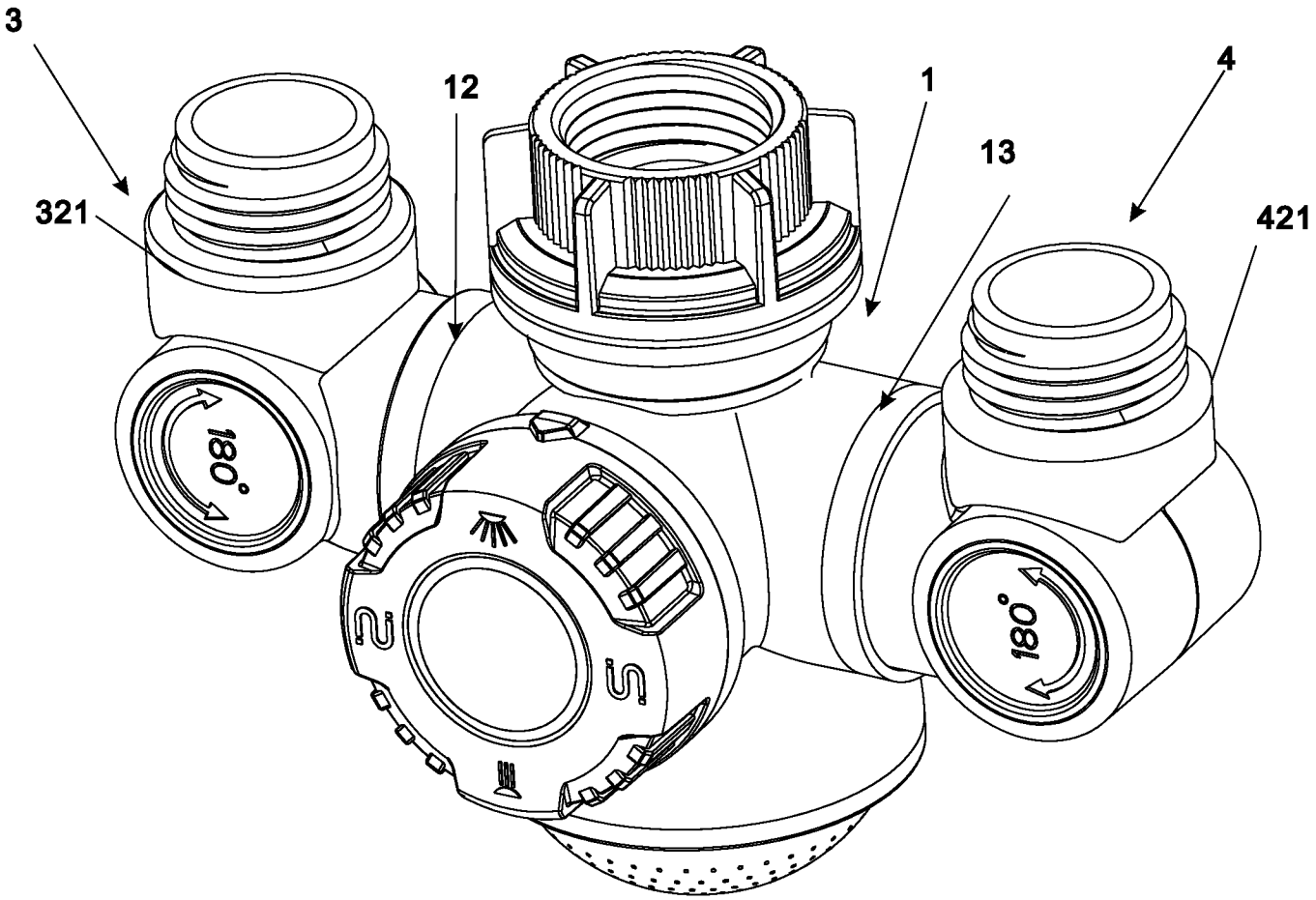
FIG. 18 is a further perspective view of an embodiment showing a first assembly part and a second assembly part being rotated to a further direction according to the present invention.

Refer to FIG. 2, FIG. 3, FIG. 6-9, how does the control part 6 work to control directions of water flows is revealed. In the beginning, couple the coupling part 2 to the faucet A and rotate the coupling part 2 for fastening the coupling part 2 to the faucet A. After the faucet A being turned on, a water flow is flowing from the inlet channel 11*a* to the diversion part 15*a* and then rotate the operation member 61 to make the valve hole 631 of the valve 63 align with the second outlet port 151*b* or the third outlet port 151*c* for switching the water flow to pass through the first channel 12*a* or the second channel 13*a*, and then flow to the first assembly part 3 or the second assembly part 4 respectively, as shown in FIG. 12 and FIG. 14. The operation member 61 can also be rotated to make the valve hole 631 of the valve 63 align with the fourth outlet port 151*d* for switching the water flow to pass through the third channel 14*a* and the first guiding hole 521 of the spray part 5 and then spray out vertically through the first outlet hole 511, as shown in FIG. 9 and FIG. 10. Or the operation member 61 is rotated to make the valve hole 631 of the valve 63 align with the first outlet port 151*a* for switching the water flow to pass through the fourth channel 14*b* and the second guiding holes 522 of the spray part 5 and then flow out in a radial pattern through the second outlet holes 512, as shown in FIG. 5 and FIG. 8.

Figure 2:
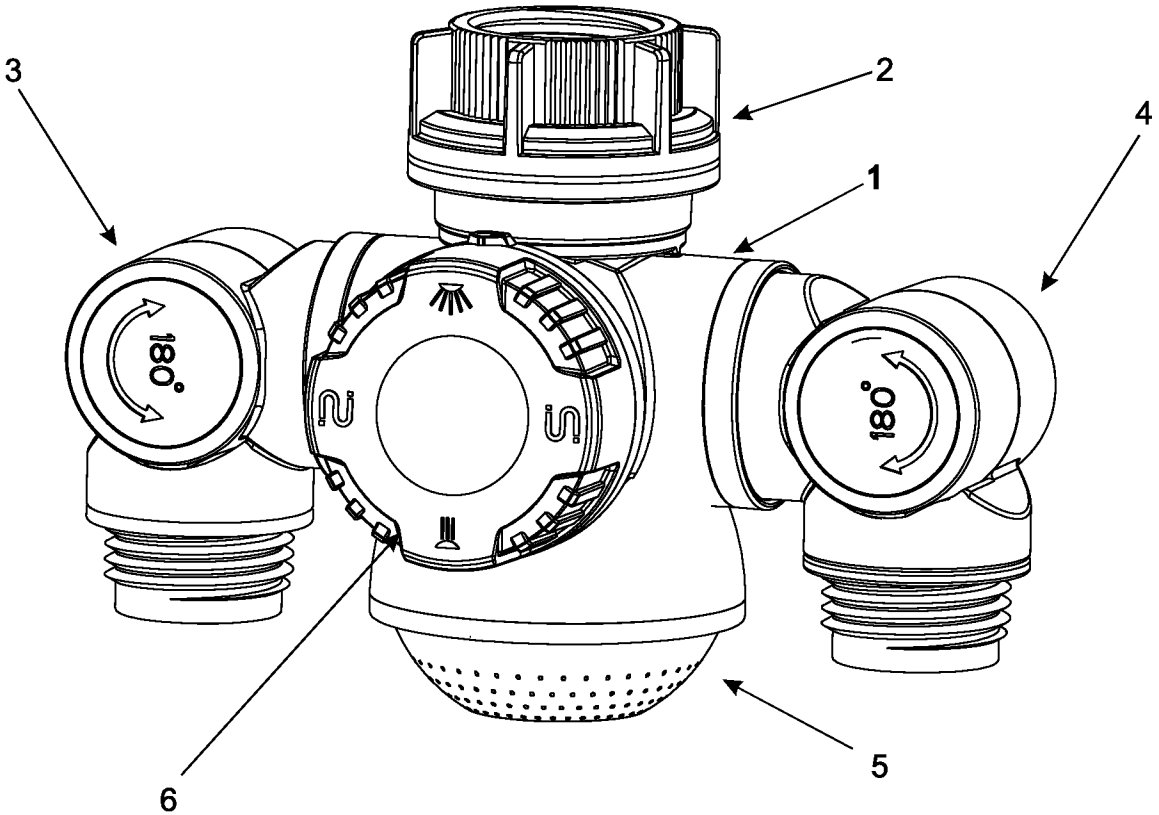
FIG. 2 is a perspective view of an embodiment according to the present invention.
Figure 3:
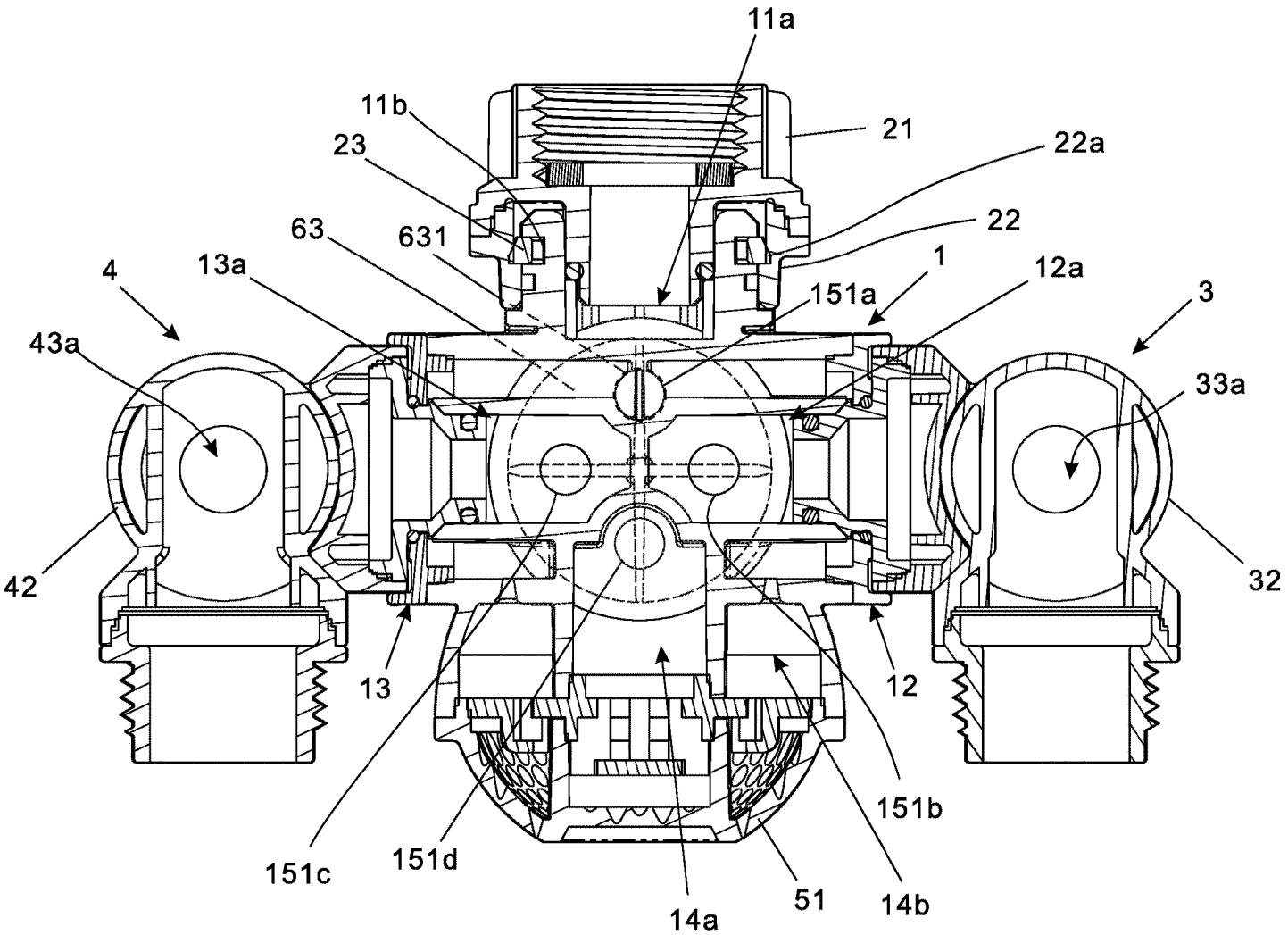
FIG. 3 is a sectional view of an embodiment according to the present invention.
Figure 4:
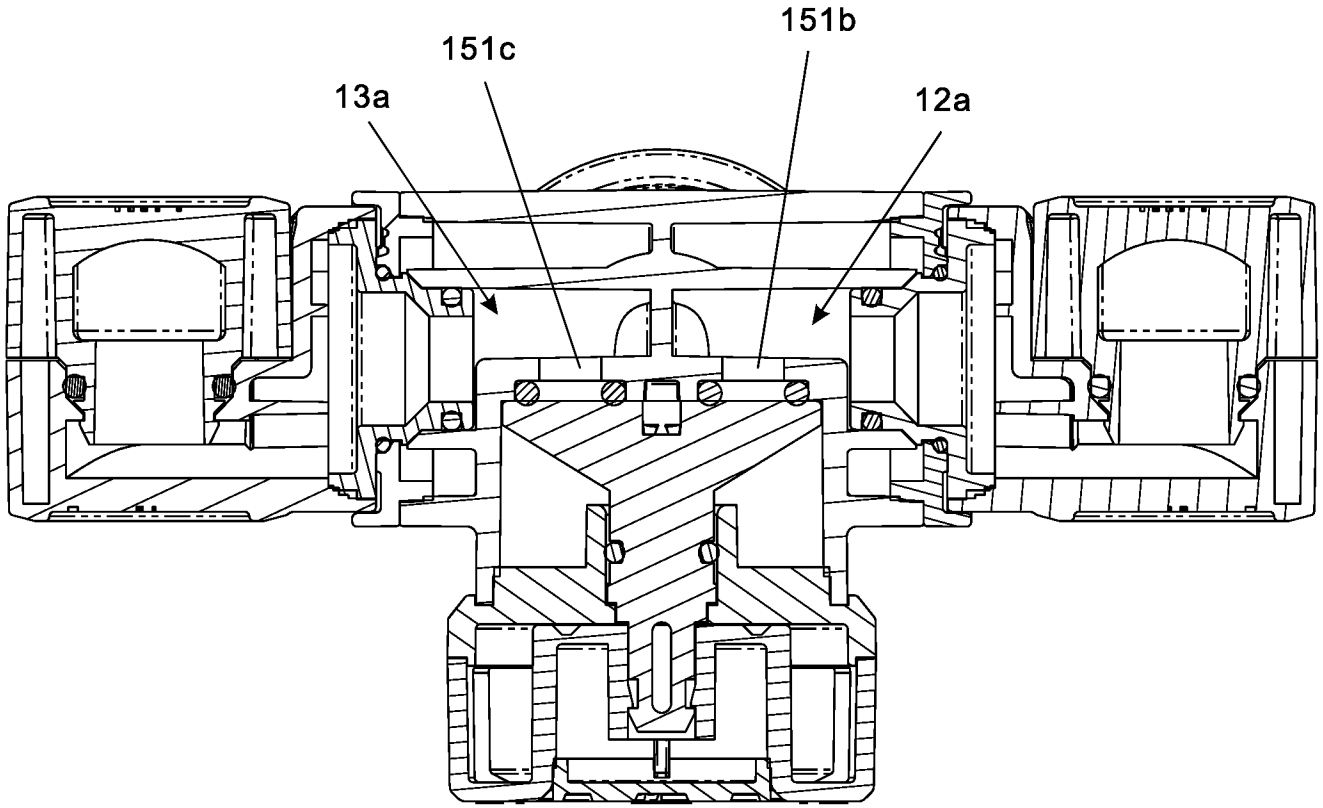
FIG. 4 is another sectional view of an embodiment according to the present invention.
Figure 19:
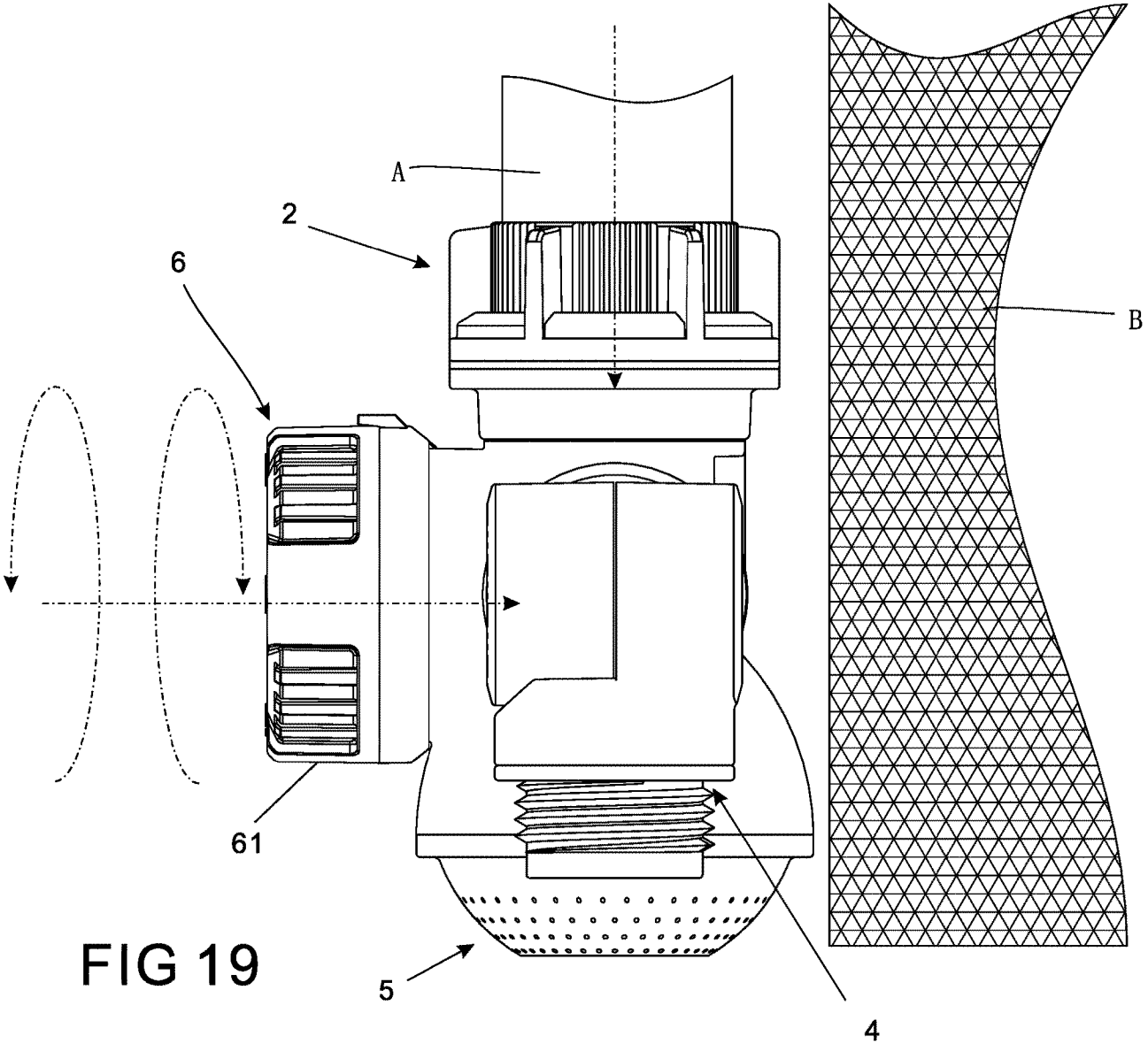
FIG. 19 is a schematic drawing showing an embodiment being connected to a faucet and its location relative to a wall surface according to the present invention.

In summary, the present invention has the following advantages:

Refer to FIG. 2 and FIG. 19, the control part 6 is arranged at the front side of the main body 1 while the two sides of the control part 6 are provided with the first assembly part 3 and the second assembly part 4 respectively. The spray part 5 is disposed under the control part 6 while the control part 6 is located between the first assembly part 3 and the second assembly part 4. The coupling part 2 is mounted on the main body 1 and located on the connection between the first assembly part 3 and the second assembly part 4. Refer to FIG. 19, the coupling part 2 is coupled to the faucet A and the back side is close to a wall surface B. The control part 6 is on the front side of the main body 1, just facing the user so that the user can see the control part 6 clearly and rotate the operation member 61 for switching directions of water flow conveniently.

The present invention provides the first assembly part 3 and the second assembly part 4 able to rotate to multiple directions so that directions of the first assembly part 3 and the second assembly part 4 can be changed freely for users to connect to a hose conveniently. As shown in FIG. 15-18, the first assembly part 3 and the second assembly part 4 are pivotally connected to two sides of the main body 1 respectively and able to rotate 360 degrees while the second rotary member 32 can rotate 180 degrees in relation to the first rotary member 31 and the fourth rotary member 42 can rotate 180 degrees in relation to the third rotary member 41.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A faucet diverter for coupling to a faucet, comprising:

a main body comprising a first end, a second end, a third end, a fourth end, and a fifth end extended from a top side, a left side, a right side, a bottom side, and a front side of the main body respectively, wherein the first end has an inlet channel, the second end has a first channel, the third end has a second channel, and the fourth end has a third channel, wherein the inlet channel, the first channel, the second channel, the third channel and the fourth channel are arranged separately and independently without communicating with each other;

a diversion part, which is arranged in the first end of the main body, having a first outlet port, a second outlet port, a third outlet port, and a fourth outlet port communicating with the first channel, the second channel, the third channel, and the fourth channel in such a manner that the first outlet port is aligned and communicating with the fourth channel while the second outlet port, the third outlet port and the fourth outlet port are aligned with the first channel, the second channel and the third channel respectively;

a coupling part connected to the first end of the main body for coupling to the faucet;

a first assembly part comprising a first rotary member having a first passage and a second rotary member having a second passage, wherein the first rotary member is pivotally connected to the second end such that the first rotary member is rotatable for 360 degrees in relation to the second end of the main body, and the second rotary member is pivotally connected to the first rotary member such that the second rotary member is rotatable for 180 degrees in relation to the first rotary member while the second passage is communicating with the first passage to form a first assembly passage aligned and communicating with the first channel of the main body;

a second assembly part comprising a third rotary member having a third passage and a fourth rotary member having a fourth passage, wherein the third rotary member is pivotally connected to the third end such that the third rotary member is rotatable for 360 degrees in relation to the third end of the main body, and the fourth rotary member is pivotally connected to the first rotary member such that the fourth rotary member is rotatable for 180 degrees in relation to the third rotary member while the third passage is communicating with the fourth passage to form a second assembly passage aligned and communicating with the second channel of the main body;

a spray part, connected to the fourth end of the main body, having at least one guiding hole aligned and communicating with the third channel and a first outlet hole communicating with the guiding hole; and a control part, provided at the front side of the main body and arranged to be operable with the diversion part, including an operation member arranged at the front side of the main body and located between the first assembly part and the second assembly part, and a valve mounted into the fifth end of the main body corresponding to one end of the diversion part while a valve hole of the valve is operable by the operation member to selectively align with one of the first outlet port, the second outlet port, the third outlet port, and the fourth outlet port of the diversion part, such that the inlet channel is configured to allow a water flow from the faucet flows to the diversion part, wherein when the operation member is rotated to align the valve hole of the valve with one of the second outlet port and the third outlet port for switching the water flow to pass through the first channel or the second channel and then flow to the first assembly part or the second assembly part, and that the operation member is rotated to align the valve hole of the valve with the fourth outlet port to switch the water flow to pass through the third channel and the guiding hole of the spray part and flow out through the first outlet hole of the spray part.

2. The faucet diverter, as recited in claim 1, wherein the spray part further has at least one guiding slot adjacent to the at least one guiding hole and at least one second outlet hole corresponding and communicating to the at least one guiding slot, such that when the operation member is rotated to align the valve hole of the valve with the first outlet port to switch the water flow to pass through the fourth channel and the at least one guiding slot and flow out through the at least one second outlet hole of the spray part.

3. The faucet diverter, as recited in claim 2, wherein the control part arranged on the front side of the main body is configured in such manner that when the operation member is rotated towards the second end of the main body, the first assembly part connected to the second end of the main body is switched on for the water flow to flow through, when the operation member is rotated towards the third end of the main body, the second assembly part connected to the third end of the main body is switch on for the water flow to flow through, when the operation member is rotated to the fourth end of the main body, the spray part connected to the fourth end of the main body is switch on for the water flow to flow through.

4. The faucet diverter, as recited in claim 3, wherein the control part further comprises a spring fitted therein and a cover body having a side hole and an axle hole and including a pin, wherein one end of the pin is mounted in the side hole and the valve which has a round disc configuration further comprises a rod which is extended from the center of the valve and has a circular groove mounting an oil seal ring therein, wherein one side of the operation member facing the cover body has a plurality of recesses arranged circularly and another end of the pin is selectively mounted in one of the plurality of recesses for temporary positioning after the operation member being rotated, wherein the valve is mounted in the fifth end and corresponding to a surface on one end of the diversion part while the valve hole is selectively aligned with the first outlet port, the second outlet port, the third outlet port, or the fourth outlet port of the diversion part, wherein the rod is inserted through the axial hole of the cover body to be fixed and connected to a connection part of the operation member and a periphery of the cover body is tightly connected to an outer circumference of the fifth end.

5. The faucet diverter, as recited in claim 4, wherein the spray part includes a spray disc and a baffle plate, wherein the first guiding hole is formed in a center of the baffle plate and the at least one guiding slot is formed on at least one side of the first guiding hole, wherein the first outlet is formed in the spray disc corresponding and communicating with the first guiding hole and the at least one second outlet is formed in the spray disc corresponding and communicating with the at least one guiding slot, wherein the baffle plate is mounted in the spray disc to form the spray part which is fixed and connected to the fourth end of the main body while the first guiding hole and the at least one second guiding slot of the baffle plate is aligned with the third channel and the fourth channel respectively.

6. The faucet diverter, as recited in claim 3, wherein the spray part includes a spray disc and a baffle plate, wherein the first guiding hole is formed in a center of the baffle plate and the at least one guiding slot is formed on at least one side of the first guiding hole, wherein the first outlet is formed in the spray disc corresponding and communicating with the first guiding hole and the at least one second outlet is formed in the spray disc corresponding and communicating with the at least one guiding slot, wherein the baffle plate is mounted in the spray disc to form the spray part which is fixed and connected to the fourth end of the main body while the first guiding hole and the at least one second guiding slot of the baffle plate is aligned with the third channel and the fourth channel respectively.

7. The faucet diverter, as recited in claim 2, wherein the control part further comprises a spring fitted therein and a cover body having a side hole and an axle hole and including a pin, wherein one end of the pin is mounted in the side hole and the valve which has a round disc configuration further comprises a rod which is extended from the center of the valve and has a circular groove mounting an oil seal ring therein, wherein one side of the operation member facing the cover body has a plurality of recesses arranged circularly and another end of the pin is selectively mounted in one of the plurality of recesses for temporary positioning after the operation member being rotated, wherein the valve is mounted in the fifth end and corresponding to a surface on one end of the diversion part while the valve hole is selectively aligned with the first outlet port, the second outlet port, the third outlet port, or the fourth outlet port of the diversion part, wherein the rod is inserted through the axial hole of the cover body to be fixed and connected to a connection part of the operation member and a periphery of the cover body is tightly connected to an outer circumference of the fifth end.

8. The faucet diverter, as recited in claim 7, wherein the spray part includes a spray disc and a baffle plate, wherein the first guiding hole is formed in a center of the baffle plate and the at least one guiding slot is formed on at least one side of the first guiding hole, wherein the first outlet is formed in the spray disc corresponding and communicating with the first guiding hole and the at least one second outlet is formed in the spray disc corresponding and communicating with the at least one guiding slot, wherein the baffle plate is mounted in the spray disc to form the spray part which is fixed and connected to the fourth end of the main body while the first guiding hole and the at least one second guiding slot of the baffle plate is aligned with the third channel and the fourth channel respectively.

9. The faucet diverter, as recited in claim 2, wherein the spray part includes a spray disc and a baffle plate, wherein the first guiding hole is formed in a center of the baffle plate and the at least one guiding slot is formed on at least one side of the first guiding hole, wherein the first outlet is formed in the spray disc corresponding and communicating with the first guiding hole and the at least one second outlet is formed in the spray disc corresponding and communicating with the at least one guiding slot, wherein the baffle plate is mounted in the spray disc to form the spray part which is fixed and connected to the fourth end of the main body while the first guiding hole and the at least one second guiding slot of the baffle plate is aligned with the third channel and the fourth channel respectively.

10. The faucet diverter, as recited in claim 1, wherein the control part arranged on the front side of the main body is configured in such manner that when the operation member is rotated towards the second end of the main body, the first assembly part connected to the second end of the main body is switched on for the water flow to flow through, when the operation member is rotated towards the third end of the main body, the second assembly part connected to the third end of the main body is switch on for the water flow to flow through, when the operation member is rotated to the fourth end of the main body, the spray part connected to the fourth end of the main body is switch on for the water flow to flow through.

11. The faucet diverter, as recited in claim 10, wherein the control part further comprises a spring fitted therein and a cover body having a side hole and an axle hole and including a pin, wherein one end of the pin is mounted in the side hole and the valve which has a round disc configuration further comprises a rod which is extended from the center of the valve and has a circular groove mounting an oil seal ring therein, wherein one side of the operation member facing the cover body has a plurality of recesses arranged circularly and another end of the pin is selectively mounted in one of the plurality of recesses for temporary positioning after the operation member being rotated, wherein the valve is mounted in the fifth end and corresponding to a surface on one end of the diversion part while the valve hole is selectively aligned with the first outlet port, the second outlet port, the third outlet port, or the fourth outlet port of the diversion part, wherein the rod is inserted through the axial hole of the cover body to be fixed and connected to a connection part of the operation member and a periphery of the cover body is tightly connected to an outer circumference of the fifth end.

12. The faucet diverter, as recited in claim 11, wherein the spray part includes a spray disc and a baffle plate, wherein the first guiding hole is formed in a center of the baffle plate and the first outlet hole is formed in the spray disc corresponding and communicating with the first guiding hole, wherein the baffle plate is mounted in the spray disc to form the spray part which is fixed and connected to the fourth end of the main body while the first guiding hole of the baffle plate is aligned with the third channel.

13. The faucet diverter, as recited in claim 10, wherein the spray part includes a spray disc and a baffle plate, wherein the first guiding hole is formed in a center of the baffle plate and the first outlet hole is formed in the spray disc corresponding and communicating with the first guiding hole, wherein the baffle plate is mounted in the spray disc to form the spray part which is fixed and connected to the fourth end of the main body while the first guiding hole of the baffle plate is aligned with the third channel.

14. The faucet diverter, as recited in claim 1, wherein the control part further comprises a spring fitted therein and a cover body having a side hole and an axle hole and including a pin, wherein one end of the pin is mounted in the side hole and the valve which has a round disc configuration further comprises a rod which is extended from the center of the valve and has a circular groove mounting an oil seal ring therein, wherein one side of the operation member facing the cover body has a plurality of recesses arranged circularly and another end of the pin is selectively mounted in one of the plurality of recesses for temporary positioning after the operation member being rotated, wherein the valve is mounted in the fifth end and corresponding to a surface on one end of the diversion part while the valve hole is selectively aligned with the first outlet port, the second outlet port, the third outlet port, or the fourth outlet port of the diversion part, wherein the rod is inserted through the axial hole of the cover body to be fixed and connected to a connection part of the operation member and a periphery of the cover body is tightly connected to an outer circumference of the fifth end.

15. The faucet diverter, as recited in claim 14, wherein the spray part includes a spray disc and a baffle plate, wherein the first guiding hole is formed in a center of the baffle plate and the first outlet hole is formed in the spray disc corresponding and communicating with the first guiding hole, wherein the baffle plate is mounted in the spray disc to form the spray part which is fixed and connected to the fourth end of the main body while the first guiding hole of the baffle plate is aligned with the third channel.

16. The faucet diverter, as recited in claim 1, wherein the spray part includes a spray disc and a baffle plate, wherein the first guiding hole is formed in a center of the baffle plate and the first outlet hole is formed in the spray disc corresponding and communicating with the first guiding hole, wherein the baffle plate is mounted in the spray disc to form the spray part which is fixed and connected to the fourth end of the main body while the first guiding hole of the baffle plate is aligned with the third channel.

* * * * *